US010428400B2

(12) United States Patent
Drillet et al.

(10) Patent No.: US 10,428,400 B2
(45) Date of Patent: Oct. 1, 2019

(54) STEEL SHEET HAVING HIGH TENSILE STRENGTH AND DUCTILITY

(71) Applicant: ArcelorMittal France, La Plaine Saint Denis (FR)

(72) Inventors: Pascal Drillet, Rozerieulles (FR); Damien Ormston, Dunkirk (FR)

(73) Assignee: ARCELORMITTAL FRANCE, Saint Denis (FR)

( * ) Notice: Subject to any disclaimer, the term of this patent is extended or adjusted under 35 U.S.C. 154(b) by 74 days.

(21) Appl. No.: 15/879,944

(22) Filed: Jan. 25, 2018

(65) Prior Publication Data

US 2018/0148806 A1 May 31, 2018

Related U.S. Application Data

(62) Division of application No. 14/575,475, filed on Dec. 18, 2014, now Pat. No. 10,214,792, which is a division of application No. 12/668,188, filed as application No. PCT/FR2008/000993 on Jul. 9, 2008, now abandoned.

(30) Foreign Application Priority Data

Jul. 19, 2007 (EP) ..... 07290908

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/24*** | (2006.01) |
| ***C22C 38/38*** | (2006.01) |
| ***C21D 6/00*** | (2006.01) |
| ***C22C 38/26*** | (2006.01) |
| ***C23C 2/02*** | (2006.01) |
| ***C23C 2/06*** | (2006.01) |
| ***C23C 2/12*** | (2006.01) |

(52) U.S. Cl.

CPC ..... *C21D 8/0263* (2013.01); *C21D 6/002* (2013.01); *C21D 6/005* (2013.01); *C21D 6/008* (2013.01); *C21D 8/0226* (2013.01); *C21D 9/46* (2013.01); *C22C 38/001* (2013.01); *C22C 38/02* (2013.01); *C22C 38/06* (2013.01); *C22C 38/22* (2013.01); *C22C 38/24* (2013.01); *C22C 38/26* (2013.01); *C22C 38/38* (2013.01); *C23C 2/02* (2013.01); *C23C 2/06* (2013.01); *C23C 2/12* (2013.01); *Y10T 428/12757* (2015.01); *Y10T 428/12799* (2015.01)

(58) Field of Classification Search

CPC ..... C21D 8/02; C21D 8/0263; C21D 6/002; C21D 6/005; C21D 6/008; C22C 38/001; C22C 38/02; C22C 38/06

USPC ..... 148/522

See application file for complete search history.

(56) References Cited

U.S. PATENT DOCUMENTS

| | | | |
|---|---|---|---|
| 3,807,990 | A | 4/1974 | Gohda et al. |
| 5,545,270 | A | 8/1996 | Koo et al. |
| 6,248,191 | B1 | 6/2001 | Luton et al. |
| 6,264,760 | B1 | 7/2001 | Tamichiro et al. |
| 6,554,919 | B2 | 4/2003 | Bano et al. |
| 8,747,577 | B2 | 6/2014 | Yoshinaga et al. |
| 2004/0244877 | A1 | 12/2004 | Yokoi et al. |
| 2007/0089814 | A1 | 4/2007 | Sugiura et al. |
| 2008/0283158 | A1 | 11/2008 | Nagao et al. |

FOREIGN PATENT DOCUMENTS

| | | | |
|---|---|---|---|
| CN | 1265709 | A | 9/2000 |
| DE | 10130744 | C1 | 12/2002 |
| EP | 1731626 | A1 | 12/2006 |
| EP | 1764423 | A1 | 3/2007 |
| JP | 04358022 | B2 | 12/1992 |
| JP | 1096042 | A | 4/1998 |
| JP | 2000282175 | A | 10/2000 |
| JP | 2003321739 | A | 11/2003 |
| JP | 2004332099 | A | 11/2004 |
| KR | 20060096002 | A | 9/2006 |
| RU | 2016127 | C1 | 7/1994 |
| RU | 2151214 | C1 | 6/2000 |
| RU | 2210603 | C2 | 8/2003 |
| SU | 1749307 | A1 | 7/1992 |
| WO | 2005005670 | A1 | 1/2005 |

OTHER PUBLICATIONS

Courbs de Transformation des Aciers de Fabrication Francaise. Publications de l'Institut de Recherches de la Siderurgie Francaise. 1974.

*Primary Examiner* — Edward M Johnson

(74) *Attorney, Agent, or Firm* — Davidson, Davidson & Kappel, LLC

(57) ABSTRACT

A hot-rolled steel sheet having a tensile strength greater than 800 MPa and an elongation at break greater than 10% is provided. A composition of the steel includes, the contents being expressed by weight: 0.050%≤C≤0.090%, 1%≤Mn≤2%, 0.015%≤Al≤0.050%, 0.1%≤Si≤0.3%, 0.10%≤Mo≤0.40%, S≤0.010%, P≤0.025%, 0.003%≤N≤0.009%, 0.12%≤V≤0.22%, Ti≤0.005%, Nb≤0.020% and optionally, Cr≤0.45%. A balance of the composition includes iron and inevitable impurities resulting from the smelting. A microstructure of the sheet or part includes, as a surface fraction, at least 80% upper bainite, and a remainder includes lower bainite, martensite and residual austenite. A sum of the martensite and residual austenite, as a surface fraction, is less than 5%.

14 Claims, 2 Drawing Sheets

20 μm

STEEL SHEET HAVING HIGH TENSILE STRENGTH AND DUCTILITY

CROSS REFERENCE TO RELATED APPLICATIONS

This is a divisional of U.S. application Ser. No. 14/575,475, filed Dec. 18, 2014 which is a divisional of U.S. application Ser. No. 12/669,188, filed May 11, 2010 which is a National Phase of International Patent Application PCT/FR2008/000993, filed Jul. 9, 2008, which claims the benefit of European Patent Application 07290908.8, filed Jul. 19, 2007. All applications are hereby incorporated by reference herein.

The invention relates to the manufacture of hot-rolled sheet or parts made of what are called "multiphase" steels having simultaneously a very high tensile strength and a deformability enabling cold or warm forming operations to be carried out. The invention relates more specifically to steels having a predominantly bainitic microstructure having a tensile strength greater than 800 MPa and an elongation at break greater than 10%.

BACKGROUND

The automotive industry constitutes in particular a preferential field of application of such hot-rolled steel sheet.

In particular in this industry, there is a continuous need to lighten vehicles and to increase their safety. Thus, various families of steels have been proposed for meeting these increasing requirements:

Firstly, steels have been proposed which contain microalloying elements, the hardening of which is obtained simultaneously by precipitation and by grain refining. The development of such steels was followed by that of "dual-phase" steels in which the presence of martensite within a ferrite matrix enables a tensile strength greater than 450 MPa, combined with good cold formability, to be obtained.

To achieve higher strength levels, steels exhibiting TRIP (Transformation Induced Plasticity) behavior with advantageous combinations of properties (strength/deformability) have been developed. These properties are due to the structure of such steels, which consists of a ferrite matrix containing bainite and residual austenite. Under the effect of a deformation, the residual austenite of a TRIP steel part progressively transforms to martensite, with the result that there is considerable consolidation and retardation in the appearance of necking.

To achieve, simultaneously a high yield strength/tensile strength ratio and an even higher tensile strength, i.e., above 800 MPa, multiphase steels having a predominantly bainitic structure have been developed. In the automotive industry, or in industry in general, these steels have been profitably used to manufacture structural parts. However, the formability of these parts requires at the same time a sufficient elongation. This requirement may also apply when the parts are welded and then formed. In this case, welded joints must have a sufficient formability and not result in premature fractures at the joints.

SUMMARY OF THE INVENTION

An object of the present invention is to solve the above-mentioned problems by providing a hot-rolled steel sheet having a tensile strength greater than 800 MPa together with an elongation at break greater than 10%, both in the rolling direction and in the transverse direction.

The invention provides a steel sheet that is largely insensitive to damage when being cut by a mechanical process.

Another object of the invention is to provide a steel sheet having a good capability for forming welded assemblies manufactured from this steel, in particular assemblies obtained by laser welding.

A further object of the invention is to provide a process for manufacturing a steel sheet in the uncoated, electrogalvanized or galvanized, or aluminum-coated state. This therefore requires the mechanical properties of this steel to be largely insensitive to the thermal cycles associated with continuous zinc hot-dip coating processes.

An even further object of the invention is also to provide a hot-rolled steel sheet or part available even with a small thickness, i.e. for example between 1 and 5 mm. The hot hardness of the steel must therefore not be too high in order to facilitate the rolling.

The present invention provides a hot-rolled steel sheet or part having a tensile strength greater than 800 MPa and an elongation at break greater than 10%, the composition of which comprises, the contents being expressed by weight: $0.050\% \leq C \leq 0.090\%$, $1\% \leq Mn \leq 2\%$, $0.015\% \leq Al \leq 0.050\%$, $0.1\% \leq Si \leq 0.3\%$, $0.10\% \leq Mo \leq 0.40\%$, $S \leq 0.010\%$, $P \leq 0.025\%$, $0.003\% \leq N \leq 0.009\%$, $0.12\% \leq V \leq 0.22\%$, $Ti \leq 0.005\%$, $Nb \leq 0.020\%$, and, optionally, $Cr \leq 0.45\%$, the balance of the composition consisting of iron and inevitable impurities resulting from the smelting, the microstructure of said sheet or said part comprising, as a surface fraction, at least 80% upper bainite, the possible complement consisting of lower bainite, martensite and residual austenite, the sum of the martensite and residual austenite contents being less than 5%.

The composition of the steel preferably comprises, the content being expressed by weight: $0.050\% \leq C \leq 0.070\%$.

Preferably, the composition comprises, the content being expressed by weight: $0.070\% \leq C \leq 0.090\%$.

According to a preferred embodiment, the composition comprises: $1.4\% \leq Mn \leq 1.8\%$.

Preferably, the composition comprises: $0.020\% \leq Al \leq 0.040\%$.)

The composition of the steel preferably comprises: $0.12\% \leq V \leq 0.16\%$.

According to a preferred embodiment, the composition of the steel comprises: $0.18\% \leq Mo \leq 0.30\%$.

Preferably, the composition comprises: $Nb \leq 0.005\%$.

Preferably, the composition comprises: $0.20\% \leq C \leq 0.45\%$.

According to one particular embodiment, the sheet or part is coated with a zinc-based or aluminum-based coating.

The present invention also provides a steel part with a composition and a microstructure defined above, characterized in that it is obtained by heating at a temperature T of between 400 and 690° C., then warm-drawing in a temperature range of between 350° C. and (T-20° C.) and then finally cooling down to ambient temperature.

The present invention further provides an assembly welded by a high-energy-density beam, produced from a steel sheet or part according to one of the above embodiments.

The present invention also provides a process for manufacturing a hot-rolled steel sheet or part having a tensile strength greater than 800 MPa and an elongation at break greater than 10%, in which a steel of the above composition is provided, a semi-finished product is cast, which is heated to a temperature above 1150° C. The semi-finished product is hot-rolled to a temperature $T_{ER}$ in a temperature range in which the microstructure of the steel is entirely austenitic so as to obtain a sheet. The latter is then cooled at a cooling rate $V_c$ of between 75 and 200° C./s, and then the sheet is coiled at a temperature $T_{coil}$ of between 500 and 600° C. According to a preferred embodiment, the end-of-rolling temperature $T_{ER}$ is between 870 and 930° C.

Preferably, the cooling rate $V_c$ is between 80 and 150° C./s.

Preferably, the sheet is pickled, then optionally skin-passed and then coated with zinc or a zinc alloy.

According to a preferred embodiment, the coating is carried out continuously by hot-dip coating.

Another subject of the invention is a process for manufacturing a warm-drawn part, in which a steel sheet according to one of the above features is provided, or manufactured by a process according to one of the above features, then said sheet is cut so as to obtain a blank. The blank is partly or completely heated to a temperature T of between 400 and 690° C., where it is maintained for a time of less than 15 minutes so as to obtain a heated blank, then the heated blank is drawn at a temperature of between 350 and T-20° C. in order to obtain a part that is cooled down to ambient temperature at a rate $V'_c$.

According to one particular embodiment, the rate $V'_c$ is between 25 and 100° C./s.

The present invention further provides use of a hot-rolled steel sheet according to one of the above embodiments, or manufactured by a process according to one of the above embodiments, for the manufacture of structural parts or reinforcing elements in the automotive field.

BRIEF DESCRIPTION OF THE DRAWINGS

Other features and advantages of the invention will become apparent over the course of the description below, given by way of example and with reference to the figures appended herewith, in which.

DETAILED DESCRIPTION

As regards the chemical composition of the steel, the carbon content plays an important role in the formation of the microstructure and in the mechanical properties.

According to the invention, the carbon content is between 0.050 and 0.090% by weight. Below 0.050%, insufficient strength cannot be achieved. Above 0.090%, the microstructure formed consists predominantly of lower bainite, this structure being characterized by the presence of carbides precipitated within the ferrite-bainite laths: the mechanical strength thus obtained is high, but the elongation is then considerably reduced.

Figure 1:
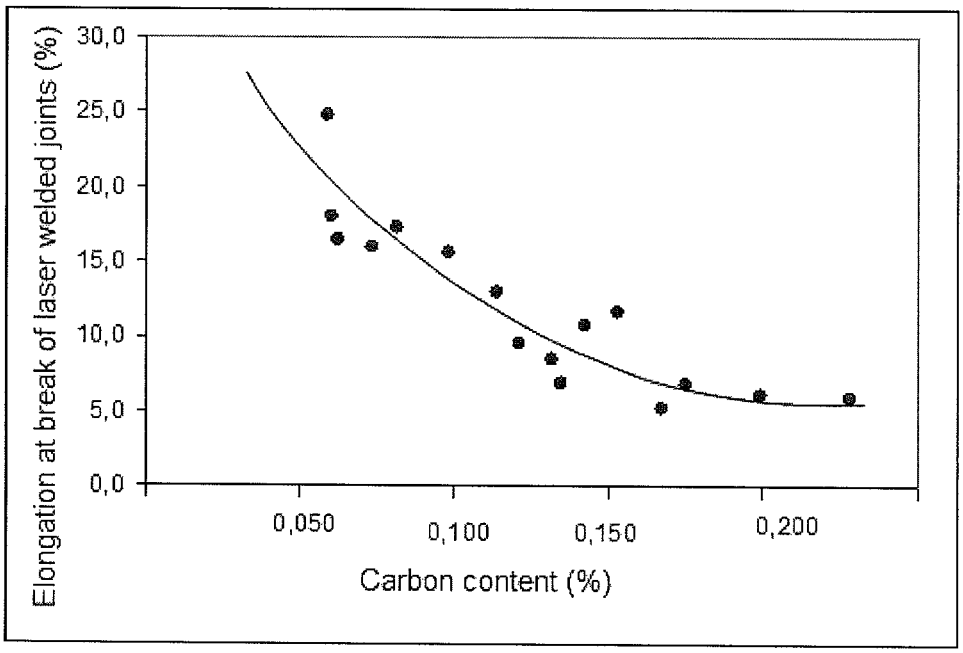
FIG. 1 illustrates the influence of the carbon content on the elongation in the longitudinal direction of butt-welded joints produced using a laser beam.

According to one particular embodiment of the invention, the carbon content is between 0.050 and 0.070%. FIG. 1 illustrates the influence of the carbon content on the elongation in the longitudinal direction of butt-welded joints produced by a laser beam. A particularly high elongation at break of around 17 to 23% is associated with a carbon content ranging from 0.050 to 0.070%. These high elongation values ensure that laser-welded sheets can be satisfactorily drawn, even when taking into account possible local imperfections such as geometrical singularities of weld beads causing stress concentrations, or microporosities within the melted metal. Compared with 0.12% C steels of the prior art, it was expected that the reduction in carbon content would improve the weldability. However, it has been demonstrated that a significant lowering of the carbon content not only makes it possible to obtain a high elongation at break, but also to simultaneously maintain the strength at a level above 800 MPa, something which was not expected for contents as low as 0.050% C.

According to another preferred embodiment, the carbon content is greater than 0.070% but does not exceed 0.090%. Even though this range does not result in as high a ductility, the elongation at break of laser welds is greater than 15% and remains comparable with that of the base steel sheet.

Manganese, in an amount of between 1 and 2% by weight, increases the hardenability and prevents the formation of ferrite upon cooling after rolling. Manganese also contributes to deoxidizing the steel in the liquid phase during smelting. The addition of manganese also contributes to effective solid-solution hardening and to obtaining a higher strength. Preferably, the manganese content is between 1.4 and 1.8%: in this way, a completely bainitic structure is formed without the risk of a deleterious banded structure appearing.

Aluminum, within a content range between 0.015% and 0.050%, is an effective element for deoxidizing the steel. This effectiveness is obtained in a particularly inexpensive and stable manner when the aluminum content is between 0.020 and 0.040%.

Silicon, in an amount not exceeding 0.1%, contributes to deoxidation in the liquid phase and to hardening in solid solution. However, an addition of silicon in excess of 0.3% causes the formation of highly adherent oxides and to the possible appearance of surface defects due in particular to the lack of wettability in the hot-galvanizing operations.

Molybdenum, in an amount not exceeding 0.10%, retards the bainite transformation during cooling after rolling, contributes to solid-solution hardening and refines the size of the bainite laths. According to the invention, the molybdenum content does not exceed 0.40% so as to prevent the excessive formation of hardening structures. This limited molybdenum content also makes it possible to lower the manufacturing cost.

According to a preferred embodiment, the molybdenum content is equal to or greater than 0.18% but does not exceed 0.30%. In this way, the level is ideally adjusted so as to prevent the formation of ferrite or pearlite in the steel sheet on the cooling table after hot rolling.

Sulphur, in an amount greater than 0.010%, tends to precipitate excessively in the form of manganese sulphides which greatly reduce the formability.

Phosphorus is an element known to segregate at grain boundaries. Its content must be limited to 0.025% so as to maintain a sufficient hot ductility.

Optionally, the composition may contain chromium in an amount not exceeding 0.45%. Thanks to the other elements of the composition and to the process according to the invention, its presence is not however absolutely necessary, this being an advantage as it avoids costly additions.

An addition of chromium of between 0.20 and 0.45% may be made as a complement to the other elements that increase the hardenability: below 0.20%, the effect on hardenability is not as pronounced, while above 0.45% the coatability may be reduced.

According to the invention, the steel contains less than 0.005% Ti and less than 0.020% Nb. If this is not the case, these elements fix too large an amount of nitrogen in the form of nitrides or carbonitrides. There then remains insufficient nitrogen available for precipitating with vanadium. In addition, an excessive precipitation of niobium would increase the hot hardness and would not enable thin hot-rolled sheet products to be easily produced.

In one particularly economic embodiment, the niobium content is less than 0.005%.

Vanadium is an important element according to the invention—the steel has a vanadium content of between 0.12 and 0.22%. Compared with a steel containing no vanadium, the increase in strength thanks to a hardening precipitation of carbonitrides may be up to 300 MPa. Below 0.12%, a significant effect on the tensile mechanical properties is noted. Above 0.22% vanadium, under the manufacturing conditions according to the invention, a saturation of the effect on the mechanical properties is noted. A content of less than 0.22% therefore makes it possible to obtain high mechanical properties very economically compared with steels having higher vanadium contents. For a vanadium content of between 0.13 and 0.15%, the refinement of the microstructure and the structure hardening obtained are most particularly effective.

According to the invention, the nitrogen content is greater than or equal to 0.003% in order to precipitate vanadium carbonitrides in sufficient quantity. However, the nitrogen content is less than or equal to 0.009% in order to prevent nitrogen from going into solid solution or to prevent the formation of larger carbonitrides, which would reduce the ductility.

The remainder of the composition consists of inevitable impurities resulting from the smelting, such as for example Sb, Sn and As.

The microstructure of the steel sheet or part according to the invention consists of:

at least 80% upper bainite, this structure consisting of ferrite-bainite laths and carbides located between these laths, the precipitation taking place during the bainitic transformation. This matrix has high strength properties combined with a high ductility. Very preferentially, the microstructure consists of at least 90% higher bainite—the microstructure is then very homogeneous and prevents deformation localization;

as possible complement, the structure contains:

lower bainite, from which the precipitation of carbides takes place within the ferrite laths. Compared with higher bainite, lower bainite has a slightly higher strength but a lower ductility; and possibly martensite. The latter is frequently associated with residual austenite in the form of M-A (martensite-residual austenite) compounds. The total content of martensite and residual austenite must be limited to 5% in order not to reduce the ductility.

The above microstructural percentages correspond to surface fractions that can be measured on polished and etched sections.

The microstructure therefore contains no primary or proeutectoid ferrite—it is therefore very homogeneous since the variation in mechanical properties between the matrix (upper bainite) and the other possible constituents (lower bainite and martensite) is small. When the steel is being mechanically stressed, the deformations are distributed uniformly. Dislocation accumulation does not occur at the interfaces between the constituents and premature damage is avoided, unlike what may be observed in structures having a significant quantity of primary ferrite, in which phase the yield point is very low, or martensite having a very high strength level. In this way, the steel sheet according to the invention is particularly capable of undergoing certain demanding modes of deformation, such as the expansion of holes, the mechanical stressing of cut edges and folding.

The process for manufacturing a hot-rolled steel sheet or part according to the invention is carried out as follows:

a steel of composition according to the invention is provided and cast to form a semi-finished product therefrom. This casting may be carried out to form ingots, or continuously to form a slab with a thickness of around 200 mm. The casting may also be carried out to form a thin slab with a thickness of a few tens of millimeters or a thin strip between counter-rotating steel rolls.

The cast semi-finished products are firstly heated to a temperature above 1150° C., so as to reach at any point a temperature favorable to the high deformations that the steel will undergo during rolling.

Of course, in the case of direct casting, of a thin slab or a thin strip between counter-rotating rolls, the step of hot-rolling these semi-finished products, starting at above 1150° C., may be carried out directly after casting so that an intermediate reheating step is in this case unnecessary.

The semi-finished product is hot-rolled in a temperature range in which the structure of the steel is fully austenitic down to an end-of-rolling temperature $T_{ER}$. The temperature $T_{ER}$ is preferably between 870 and 930° C. so as to obtain a grain size suitable for the bainitic transformation that follows.

Next, the product is cooled at a rate $V_c$ of between 75 and 200° C./s. A minimum rate of 75° C./s prevents the formation of pearlite and proeutectoid ferrite, while a rate $V_c$ not exceeding 200° C./s prevents excessive formation of martensite.

Optimally, the rate $V_c$ is between 80 and 150° C./s. A minimum rate of 80° C./s leads to the formation of upper bainite with a very small lath size, combined with excellent mechanical properties. A rate below 150° C./s prevents the formation of martensite fairly considerably.

The cooling rate range according to the invention may be obtained by means of a water or air/water mixture spray, depending on the thickness of the sheet, at the exit of the finishing mill.

After this rapid cooling phase, the hot-rolled sheet is coiled at a temperature $T_{coil}$ of between 500 and 600° C. The bainitic transformation takes place during this coiling phase. Thus, the formation of proeutectoid ferrite or pearlite, caused by too high a cooling temperature, is prevented, as is also the formation of hardening constituents that would be caused by too low a coiling temperature. In addition, the precipitation of carbonitrides occurring within this coiling temperature range enables additional hardening to be obtained.

The sheet may be used in the bare state or coated state. In the latter case, the coating may for example be a coating based on zinc or aluminum. Depending on the envisaged use, the sheet is pickled after rolling using a process known per se, so as to obtain a surface finish conducive to implementing the subsequent coating operation.

To eliminate the plateau observed in a tensile test, the sheet may optionally be subjected to a slight cold deformation, usually of less than 1% (skin pass). The sheet is then coated with zinc or with a zinc-based alloy, for example by electrogalvanizing or by continuous hot-dipped galvanizing. In the latter case, it has been demonstrated that the particular microstructure of the steel, composed predominantly of lower bainite, is insensitive to the thermal conditions of the subsequent galvanizing treatment, so that the mechanical properties of the continuously hot-dipped coated sheet are very stable even in the event of inopportune fluctuations in these conditions. The sheet in the galvanized state therefore has mechanical properties very similar to those in the uncoated state.

Next, the sheet is cut by processes known per se so as to obtain blanks suitable for the forming operation.

The inventors have also demonstrated that it is possible to benefit from the microstructure according to the invention to produce drawn parts particularly advantageously according to the following process:

Firstly, the blanks defined above are heated to a temperature T between 400 and 690° C. The duration of the soak at this temperature may range up to 15 minutes without there being any risk of the tensile strength $R_m$ of the final part dropping below 800 MPa. The heating temperature must be above 400° C. in order to lower the yield point of the steel sufficiently and allow the drawing operation that follows to be carried out with low forces, and to ensure that the springback of the drawn part is also minimal, enabling the manufacture of a part with good geometric precision. This temperature is limited to 690° C. on the one hand, during heating, to avoid a partial transformation to austenite, which would lead to the formation of hardening constituents during cooling, and, on the other hand, to prevent softening of the matrix, which would lead to a strength of less than 800 MPa on the drawn part.

Next, these heated blanks are subjected to a drawing operation in a temperature range from 350° C. to (T-20° C.) so as to form a part which is cooled down to ambient temperature. Thus, a "warm" drawing operation is carried out with the following effects:

the yield stress of the steel is reduced, thereby making it possible to use less powerful drawing presses and/or to manufacture parts that are more difficult to produce than by cold-drawing; and the temperature range of the warm-drawing takes account of the slight reduction in temperature when the blank is removed from the furnace and transferred to the drawing press: for a heating temperature of T° C., the drawing can start at a temperature of (T-20° C.). The drawing temperature must however be above 350° C. so as to limit the springback and the level of residual stresses on the final part. Compared with a cold-drawing operation, this reduction in springback enables parts to be manufactured with a better final geometric tolerance.

Surprisingly, it has been discovered that the particular microstructure of the steels according to the invention leads to very stable mechanical properties (strength, elongation) upon warm-drawing—this is because a variation in the drawing temperature or in the cooling rate after drawing does not result in a significant modification in the microstructure or in the precipitates, such as carbonitrides.

Within the conditions of the invention, an inopportune modification or a fluctuation in the heating parameters (soak temperature or soak time) or in the cooling parameters (better or worse contact between the part and the tool) therefore does not result in the parts thus produced being scrapped.

When heating and warm-drawing, a modification in the M-A compounds possibly present in an initial small amount does not result in the mechanical properties being degraded. For example, it should be noted that there is no negative effect due to destabilization of the residual austenite.

The microstructure after warm-drawing is very similar to the microstructure before drawing. This way, if not the entire blank is heated and warm-drawn, but only a portion (the portion to be drawn having been locally heated by an appropriate means, for example by induction heating), the microstructure and the properties of the final part will be very homogeneous in its various portions.

EXAMPLE 1

Steels with the composition given in the table below, expressed in percentages by weight, were produced. Apart from steel I-1, serving to manufacture sheets according to the invention, the table indicates for comparison the composition of steels R-1 and R-2 used for manufacturing reference sheets.

TABLE 1

| | Steel composition (in % by weight) | | | | | | | | | | |
|---|---|---|---|---|---|---|---|---|---|---|---|
| Steel | C (%) | Mn (%) | Si (%) | Al (%) | S (%) | P (%) | Mo (%) | Cr (%) | N (%) | V (%) | Nb (%) |
| I-1 | 0.070 | 1.604 | 0.218 | 0.028 | 0.002 | 0.014 | 0.313 | 0.400 | 0.006 | 0.150 | — |
| I2 | 0.072 | 1.592 | 0.204 | 0.031 | 0.003 | 0.024 | 0.200 | 0.414 | 0.006 | 0.211 | 0.017 |
| R1 | 0.125 | 1.670 | 0.205 | 0.030 | 0.002 | 0.025 | 0.307 | 0.414 | 0.004 | 0.105 | — |
| R2 | 0.102 | 1.680 | 0.204 | 0.023 | 0.002 | 0.028 | 0.315 | 0.408 | 0.007 | 0.205 | — |

I = according to the invention;
R = reference
Underlined values: not according to the invention.

Semi-finished products corresponding to the above composition were reheated to 1220° C. and hot-rolled down to a thickness of 2.3 mm within a range in which the structure was entirely austenitic. The manufacturing conditions (end-of-rolling temperature $T_{ER}$, cooling rate $V_c$, coiling temperature $T_{coil}$) for these steels are indicated in the following table:

TABLE 2

| | Manufacturing conditions | | |
|---|---|---|---|
| Steel | $T_{ER}$ (° C.) | $V_C$ (° C./s) | $T_{coil}$ (° C.) |
| I1 | 910 | 80 | 520 |
| I2 | 875 | 80 | 600 |
| R1 | 880 | 80 | 520 |
| R2 | 885 | 100 | 450 |

Underlined value: not according to the invention

The tensile properties (yield strength $R_e$, tensile strength $R_m$ and elongation at break A) obtained are given in Table 3 below.

TABLE 3

| Mechanical properties (in the rolling direction) | | | |
|---|---|---|---|
| Steel | $R_e$ (MPa) | $R_m$ (MPa) | Elongation at break A (%) |
| I1 | 820 | 980 | 11 |
| I2 | 767 | 831 | 16 |
| R1 | 740 | 835 | 8 |
| R2 | 870 | 927 | 7.5 |

Underlined value: not according to the invention.

The high values of the mechanical properties are obtained both in the rolling direction and in the transverse direction for the steels according to the invention.

Figure 2:
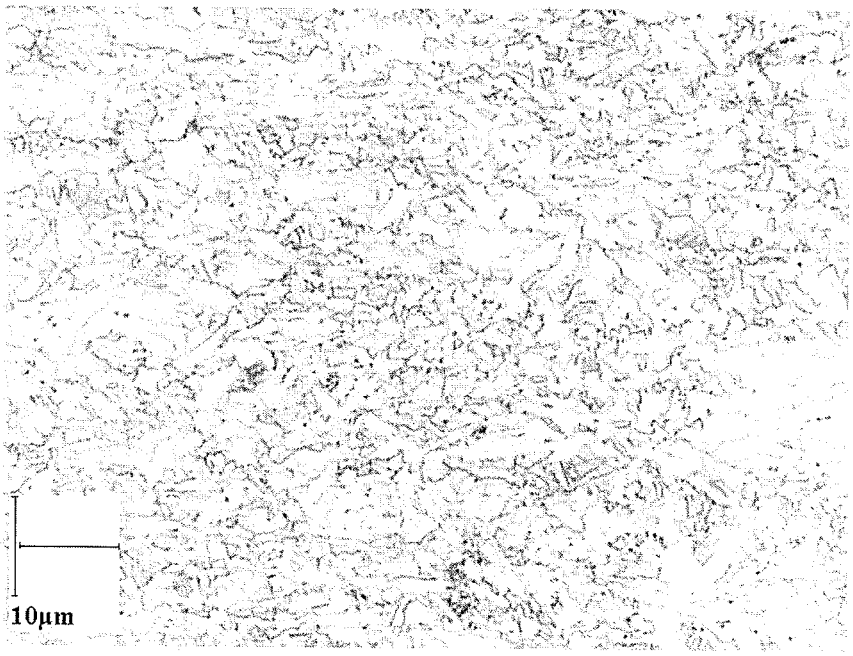
FIG. 2 illustrates the microstructure of a steel sheet or part according to the invention.

The microstructure of steel I1 illustrated in FIG. 2 comprises more than 80% upper bainite, the remainder consisting of lower bainite and M-A compounds. The total content of martensite and residual austenite is less than 5%. The size of the prior austenitic grains and of the packets of bainite laths is about 10 microns. The limitation in size of the packets of laths and the pronounced misorientation between adjacent packets has the result that there is a great resistance to the propagation of any microcracks. Thanks to the small difference in hardness between the various constituents of the microstructure, the steel is largely insensitive to damage when being cut by a mechanical process.

The sheet of steel R1, having too high a carbon content and too low a vanadium content, has an insufficient elongation at break. The steel R2 has too high a carbon content and too high a phosphorus content, and its coiling temperature is also too low. Consequently, its elongation at break is substantially below 10%.

Welding joints produced by autogenous laser welding were produced under the following conditions: power: 4.5 kW; welding speed: 2.5 m/min. The elongation in the longitudinal direction of the laser-welded joints of steel I-1 was 17%, whereas it was 10% and 13% for steels R-1 and R-2 respectively. These values result, in particular in the case of steel R1, in difficulties when drawing welded joints.

Sheets of steel I1 according to the invention are also galvanized under the following conditions: after heating to 680° C., the sheets were cooled down to 455° C. and then continuously hot-dip coated in a Zn bath at this temperature, and finally cooled down to ambient temperature. The mechanical properties of the galvanized sheets are the following: $R_e$=824 MPa; $R_m$=879 MPa; A=12%. These properties are practically identical to those of the uncoated sheet, which indicates that the microstructure of the steels according to the invention is fairly stable with respect to galvanizing thermal cycles.

EXAMPLE 2

A sheet of steel I-1, manufactured using the parameters defined in Table 2 for this steel, was cut so as to obtain blanks. After heating to a temperature T of 400° C. or 690° C., soaking at these temperatures for 7 or 10 minutes and warm-drawing at respective temperatures of 350° or 640° C., the parts obtained were cooled at a rate $V'_c$ of 25° C./s or 100° C./s down to ambient temperature. The rate $V'_c$ denotes the average cooling rate between the temperature T and ambient temperature. The tensile strength $R_m$ of the parts thus obtained is indicated in Table 4.

TABLE 4

| Strength $R_m$ obtained after warm-cooling under various conditions | | |
|---|---|---|
| | 25° C./s cooling | 100° C./s cooling |
| Heating: 400° C. - 7 minutes | 880 MPa | 875 MPa |
| Heating: 400° C. - 10 minutes | 875 MPa | 885 MPa |
| Heating: 690° C. - 10 minutes | 810 MPa | 810 MPa |

The parts drawn according to the conditions of the invention will have a low sensitivity to a variation in the manufacturing conditions: after heating to 400° C., the final strength may vary little (by 10 MPa) when the heating time and/or the cooling rate are modified.

Even for heating at 690° C., the strength of the part obtained is greater than 800 MPa.

Figure 3:
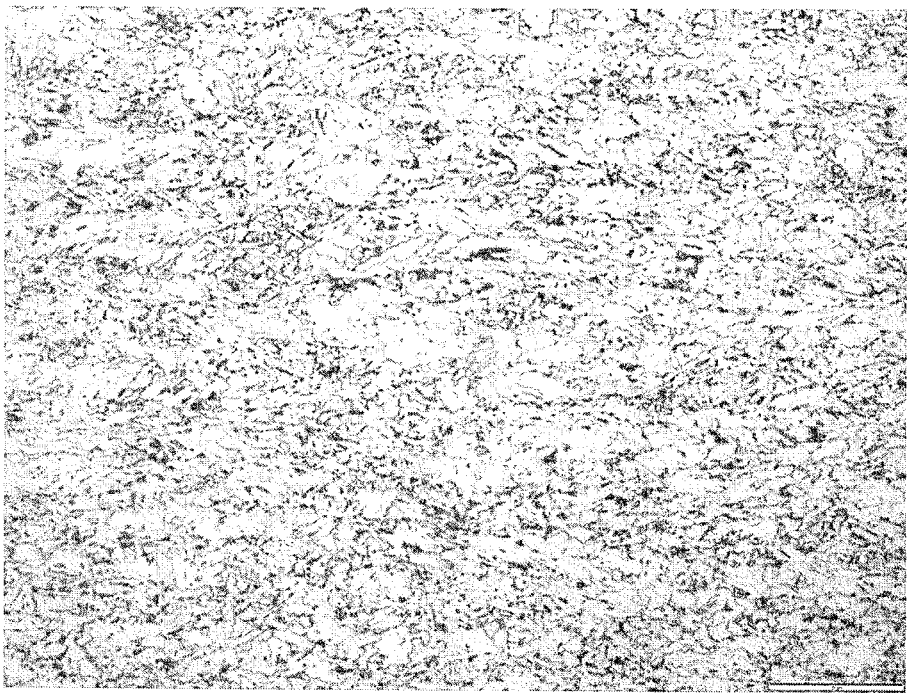
FIG. 3 illustrates the microstructure of a warm-drawn steel part according to the invention.

Compared with the initial microstructure, a slight additional precipitation of carbides is noted. The structure remains practically identical to that of a sheet that is not warm-drawn, as illustrated in FIG. 3 relating to a part reheated at 400° C. for 7 minutes and then drawn at 380° C.

Thus, the invention makes it possible to manufacture sheets or parts made of steels having a bainitic matrix without excessive addition of expensive elements. These sheets or parts combine high strength with high ductility. The steel sheets according to the invention are advantageously used to manufacture structural parts or reinforcing elements in the automotive field and general industry.

What is claimed is:

1. A hot-rolled steel sheet or part comprising:

a tensile strength greater than 800 MPa;

an elongation at break greater than 10%;

a composition of the steel comprising, the contents being expressed by weight:

$0.050\% \leq C \leq 0.090\%$;

$1.4\% \leq Mn \leq 1.8\%$;

$0.015\% \leq Al \leq 0.050\%$;

$0.1\% \leq Si \leq 0.3\%$;

$0.10\% \leq Mo \leq 0.40\%$;

$S \leq 0.010\%$;

$P \leq 0.025\%$;

$0.003\% \leq N \leq 0.009\%$;

$0.12\% < V \leq 0.22\%$;

$Ti < 0.005\%$;

$Nb \leq 0.020\%$; and a balance of the composition comprising iron and inevitable impurities resulting from the smelting; and a microstructure of the sheet or part comprising:

at least 80% upper bainite, as a surface fraction;

a remainder consisting of lower bainite, martensite and residual austenite; and a sum of the martensite and residual austenite, as a surface fraction, being less than 5%.

2. The steel sheet or part according to claim 1, wherein the composition of the steel comprises, the content being expressed by weight:

$0.050\% \leq C \leq 0.070\%$.

3. The steel sheet or part according to claim 1, wherein the composition of the steel comprises, the content being expressed by weight:

$0.070\% \leq C \leq 0.090\%$.

4. The steel sheet or part according to claim 1, wherein the composition of the steel comprises, the content being expressed by weight:

$0.020\% \leq Al \leq 0.040\%$.

5. The steel sheet or part according to claim 1, wherein the composition of the steel comprises, the content being expressed by weight:

$0.12\% < V \leq 0.16\%$.

6. The steel sheet or part according to claim 1, wherein the composition of the steel comprises, the content being expressed by weight:

$0.18\% \leq Mo \leq 0.30\%$.

7. The steel sheet or part according to claim 1, wherein the composition of the steel comprises, the content being expressed by weight:

$Nb \leq 0.005\%$.

8. The steel sheet or part according to claim 1, wherein the composition of the steel comprises, the content being expressed by weight:

$Cr \leq 0.45\%$.

9. The steel sheet or part according to claim 1, wherein the composition of the steel comprises, the content being expressed by weight:

$0.20\% \leq Cr \leq 0.45\%$.

10. The steel sheet or part according to claim 1, wherein the sheet or said part is coated with a zinc-based or aluminum-based coating.

11. The steel part with a composition and a microstructure according to claim 1, manufactured by a process comprising the steps of:

heating at a temperature T of between 400 and 690° C.;

warm-drawing a temperature range of between 350° C. and (T-20° C.); and then cooling down to ambient temperature.

12. A welded assembly comprising:

at least one steel sheet or part according to claim 1 welded by a high-energy-density beam.

13. A hot-rolled steel sheet or part comprising:

a tensile strength greater than 800 MPa;

an elongation at break greater than 10%;

a composition of the steel comprising, the contents being expressed by weight:

$0.050\% \leq C \leq 0.090\%$;

$1\% \leq Mn \leq 2\%$;

$0.015\% \leq Al \leq 0.050\%$;

$0.1\% \leq Si \leq 0.3\%$;

$0.10\% \leq Mo \leq 0.40\%$;

$S \leq 0.010\%$;

$P \leq 0.025\%$;

$0.003\% \leq N \leq 0.009\%$;

$0.12\% < V \leq 0.22\%$;

$Ti < 0.005\%$;

$Nb \leq 0.020\%$;

$Cr \leq 0.45\%$; and a balance of the composition consisting of iron and inevitable impurities resulting from the smelting; and a microstructure of the sheet or part comprising:

at least 80% upper bainite, as a surface fraction;

a remainder consisting of lower bainite, martensite and residual austenite; and a sum of the martensite and residual austenite, as a surface fraction, being less than 5%.

14. The steel sheet or part according to claim 13, wherein the composition of the steel comprises, the content being expressed by weight: $1.4\% \leq Mn \leq 1.8\%$.

* * * * *